United States Patent [19]

Cherrington et al.

[11] Patent Number: 4,785,885

[45] Date of Patent: Nov. 22, 1988

[54] METHOD AND APPARATUS FOR CEMENTING A PRODUCTION CONDUIT WITHIN AN UNDERGROUND ARCUATE BORE

[76] Inventors: Martin D. Cherrington, 8600 Emperor Dr., Fair Oaks, Calif. 95628; William D. Cherrington, 833 Keysport Dr., Citrus Heights, Calif. 95610

[21] Appl. No.: 49,662

[22] Filed: May 13, 1987

[51] Int. Cl.[4] ..... E21B 7/04; E21B 7/08; E21B 33/14

[52] U.S. Cl. ..... 166/285; 175/53; 175/61; 175/67; 175/325

[58] Field of Search ..... 175/21, 53, 61, 62, 175/67, 73, 72, 162, 203, 320, 325, 350, 406, 424; 405/184; 166/50, 285, 287

[56] References Cited

U.S. PATENT DOCUMENTS

| | | | |
|---|---|---|---|
| 2,705,050 | 3/1955 | Davis et al. | 175/72 X |
| 3,526,280 | 9/1970 | Aulick | 166/285 |
| 4,318,835 | 3/1982 | Clarke | 405/184 X |
| 4,384,624 | 5/1983 | Duke et al. | 175/19 |
| 4,396,075 | 8/1983 | Wood et al. | 175/61 X |
| 4,401,170 | 8/1983 | Cherrington | 175/73 |
| 4,402,551 | 9/1983 | Wood et al. | 166/285 X |
| 4,445,574 | 5/1984 | Vann | 175/62 X |
| 4,453,603 | 6/1984 | Voss et al. | 175/53 |
| 4,501,513 | 2/1985 | Warner et al. | 175/61 X |
| 4,679,637 | 7/1987 | Cherrington et al. | 175/61 |
| 4,687,060 | 8/1987 | Richards et al. | 166/285 |

OTHER PUBLICATIONS

Pp. 2408, 2409, 2425, 2442 of 1986-1987, Composite Catalog of Oil Field Eqpt & Services

*Primary Examiner*—George A. Suchfield
*Attorney, Agent, or Firm*—Vinson & Elkins

[57] ABSTRACT

An apparatus and method for drilling a bore hole (B) along an underground arcuate path (P) between two surface locations (O,E). The bore hole (B) is drilled in one direction with a drill string (10) having a leading pipe section 12 with a drill bit (14) thereon. Drilling fluid is supplied to the drill bit (14) during the drilling operation. Upon completion of the initial bore hole (B), the hole (B) may be enlarged by a reamer (40). Then, a production conduit (38) is connected to the reamer (40) for being pulled by the drill string (10) through the enlarged bore hole (D). Cement is supplied through the drill string (10) for discharge at the reamer (40) into the bore hole (D) adjacent the leading end of the production conduit (38) and fills the annulus A between the conduit (38) and the inner peripheral surface of the enlarged bore hole (D). In one embodiment (FIG. 12), the drill string (10B) is encased in cement in the initial bore hole (B) and forms a casing for receiving a small diameter production cable.

15 Claims, 5 Drawing Sheets

FIG. 9
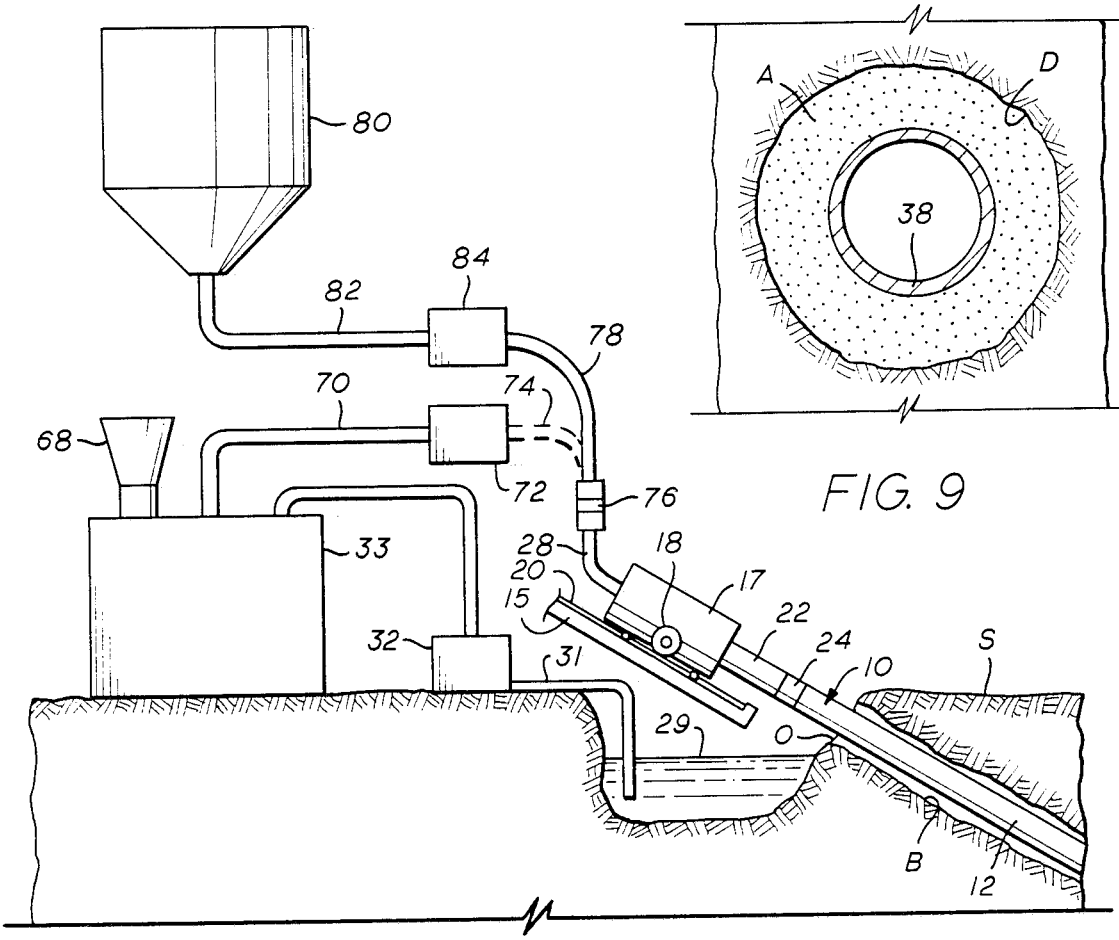
FIG. 10
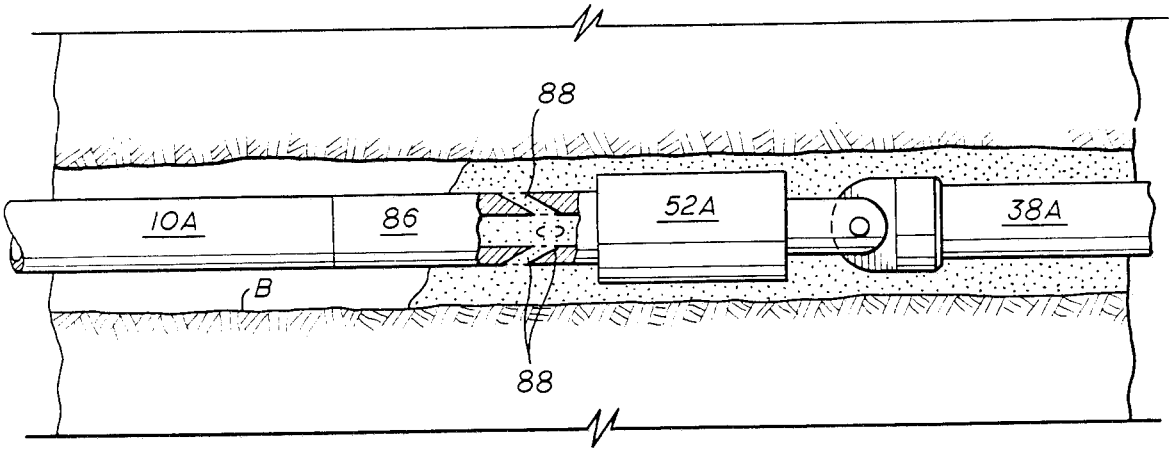
FIG. 11

METHOD AND APPARATUS FOR CEMENTING A PRODUCTION CONDUIT WITHIN AN UNDERGROUND ARCUATE BORE

BACKGROUND OF THE INVENTION

This invention relates to a method and apparatus for cementing a production conduit within an underground arcuate bore drilled along an arcuate path between two surface locations, such as disclosed in our copending application Ser. No. 853,344 filed Apr. 17, 1986, now U.S. Pat. No. 4,679,637.

Copending application Ser. No. 853,344, the entire disclosure of which is incorporated by this reference, describes an apparatus and method for drilling in one direction of travel a pilot bore hole along an underground arcuate path between two earth surface locations, and then enlarging in an opposite direction of travel the initial pilot bore hole for receiving a production conduit therein. A conventional drill pipe string is utilized in drilling the initial bore hole and the drill string may have a spud bit on its leading end for thrusting the drill string along a predetermined arcuate path to form an initial pilot bore hole of a relative small diameter, such as around five (5) inches in diameter for example. As an alternative, a rotary drill bit may be provided on the leading end of a drill string with an in-hole hydraulic motor for rotating the drill bit such as might be desirable when relatively hard formations are encountered. After the drilling of the initial pilot bore hole and exit of the drill string from the exit surface opening, the drill bit on the end of the drill string is removed and a reamer is connected to the drill string at the exit end for pulling back through the hole for enlarging the pilot bore hole to the desired diameter for the production conduit. The production conduit is pulled into the hole trailing the reamer, either in the initial reaming step or in a separate step after the enlargement of the pilot bore hole by the reamer. An annulus is formed about the production conduit of a thickness around two (2) to six (6) inches, for example, dependent on the diameter of the production conduit and the type of formation encountered. For example, the enlarged opening may be around thirty (30) inches in diameter for a production conduit of twenty (20) inches in diameter, such as a pipeline, thereby providing an annulus between the pipeline and the adjacent surface defining the enlarged opening having a thickness of five (5) inches. Heretofore, cementing methods have been utilized in vertical drilling for cementing the annulus between the outside of the casing in the vertical bore hole and the wall of the hole, or to seal between inner and outer casing strings. The cement has normally been pumped down the hole into the annulus and has been effective to seal the casing within the bore hole. Various types of plugs have been provided within the inner casing or drill string to divert the cement outwardly into the annulus.

SUMMARY OF THE INVENTION

In certain locations in which the production conduit is placed, such as under levees or elevated waterway, fissures or "piping" may occur resulting in an erosion of the formation about the production conduit. Under these conditions it may be desirable to seal any void areas, such as the annulus about the production conduit, to minimize erosion or washing into the void area along the production conduit.

This invention is directed to an apparatus and method for sealing the annulus about the production conduit after the conduit is positioned within an arcute underground bore extening between two surface locations. The annulus is sealed by pumping a cement into the annulus generally string and discharging the cement into the annulus generally adjacent the leading end of the production conduit being pulled through the enlarged bore hole by the drill pipe string. Thus during the pulling of the production conduit through the enlarged bore hole, the cement is being discharged simultaneously into the annulus around the production conduit adjacent the leading end of the production conduit string which continuously increases in length from the exit end of the bore hole by the addition of production conduit sections to the trailing end of the conduit line at the exit opening. It is necessary that the entire production conduit line be in its final location prior to the setting or hardening of the cement.

The weight of the cement in the annulus as well as the cement in the drill string would provide sufficient weight to prevent the product pipe and drill string from being buoyant under conditions encountered in which a problem of buoyancy may arise. Also, after the production pipe is encased in a ring of hardened cement of a predetermined thickness as may be predetermined by the thickness of the annulus, the production conduit will not have a tendency to become buoyant.

The cement being discharged from a drill string also acts as drilling fluid to aid the reamer during the reaming operation as well as acting as a lubricant to reduce friction between the inner peripheral surface of the bore hole and the outer peripheral surface of the product conduit for assisting the longitudinal movement of the production conduit as it is pulled along the bore hole from the exit end.

In one embodiment, the original drill string is encased in cement and used as a cemented casing to receive a production cable or conduit therein. The cement is discharged from the drill string in a separate pass of the drill string from the entrance opening of the original bore hole to the exit opening after the spud bit has been removed and the drill string withdrawn to the entrance opening.

It is an object of the present invention to provide a method and apparatus for cementing a production conduit within an underground arcuate bore drilled along an arcuate path between two surface locations defining an entrance opening and an exit opening.

A further object of this invention is to provide a method and apparatus for cementing a drill string within an arcuate bore hole for receiving a small diameter production conduit or cable therein.

It is a further object of this invention to provide such an apparatus and method in which a drill pipe string is utilized for supplying cement to the annulus between the bore hole and the production conduit adjacent the leading end of the production conduit as it is being pulled along the arcuate bore hole.

An additional object of the invention is to provide such an apparatus and method for cementing a production conduit in which an enlarged bore hole is formed by reaming and the cement discharged at the reamer acts both as a drilling fluid for the reaming operation and a lubricant to assist the passage of the production conduit being pulled into and along the enlarged bore hole after the reaming operation.

Other objects, features, and advantages of this invention will become more apparent after referring to the following specification and drawings.

DESCRIPTION OF THE INVENTION

FIG. 9 is a section taken generally along the line 9—9 of FIG. 5 and showing the production conduit in the bore hole with cement in the annulus between the production conduit and the inner periphery of the enlarged bore opening;

FIG. 10 is a schematic showing the supply of drilling fluid to the drill string or alternately the supply of cement to the drilling string for being discharged at the leading end of the drill string;

Figure 12:
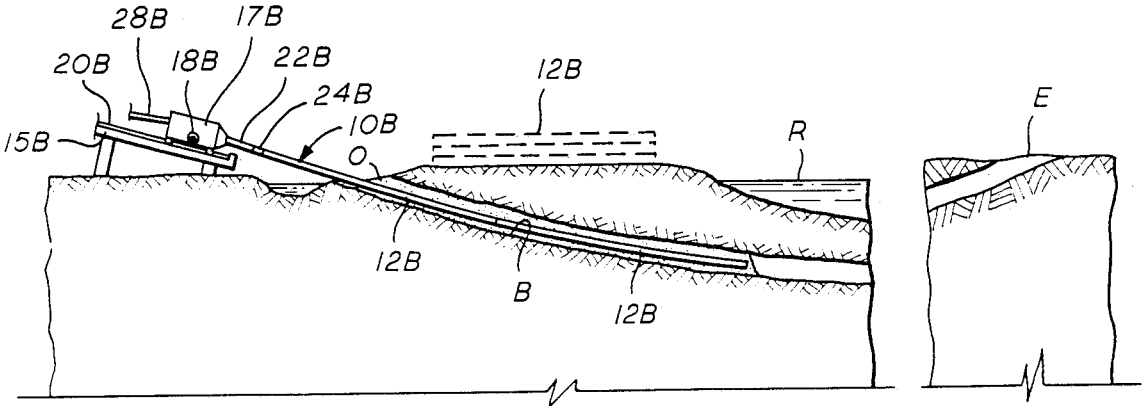

FIG. 11 is a side elevation, partly in section, of a separate embodiment of the invention in which the initial pilot bore hole is not enlarged and a sub on the leading end of the drill string has nozzles for the discharge of cement and is connected to a small diameter casing or product cable for pulling the casing or cable through the initial pilot bore hole; and FIG. 12 is a schematic side elevation of a further embodiment of the invention in which the original drill string for drilling the bore hole is encased in cement for receiving a small diameter production conduit or cable therein.

Figure 1:
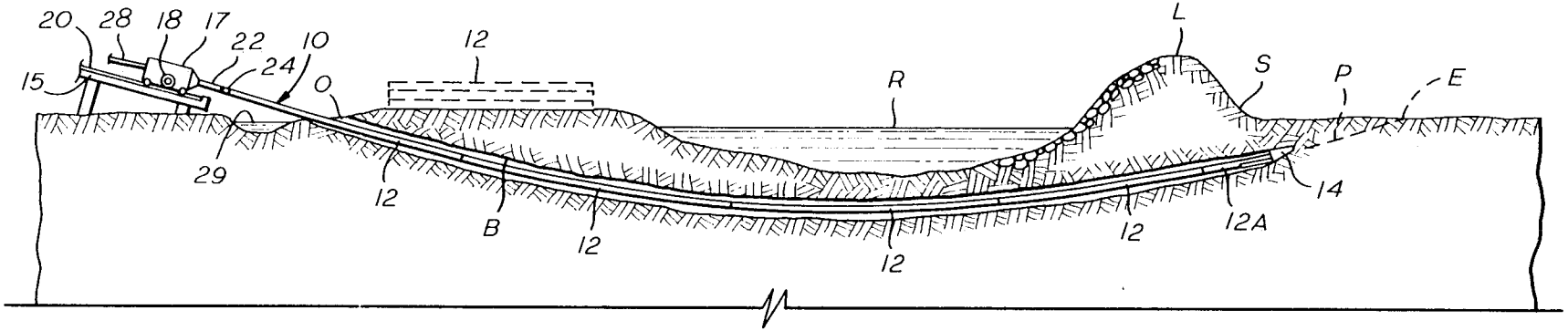
FIG. 1 is a schematic cross-section of the initial drilling operation in drilling an inverted arcuate pilot hole or bore from an earth entry opening to an earth exit opening beneath a levee and adjacent waterway utilizing the apparatus and method of the present invention.

Referring now to the drawings for a better understanding of our invention, reference is made to FIG. 1 in which an arcuate pilot bore hole is illustrated at B extending along an underground path shown at P. Path P extends from an earth surface entrance opening O to an earth surface exit opening E underneath an obstruction shown as a river R alongside a levee L.

While exit opening E is shown as a surface exit opening in the drawings, the terms "exit opening", "surface exit opening" or "surface location" as used in the specification and claims shall be interpreted as including an opening beneath the surface or underwater at which a product conduit or pipe is connected to the drill string to be pulled through the bore hole, such as an underground cable.

A drill string indicated generally at 10 includes a plurality of connected pipe sections 12 with a spud bit 14 on the end of a leading pipe section 12A. Drill string 10 is utilized to drill small diameter pilot bore hole B along path P. A plurality of lengths or sections of pipe string 10 are normally positioned adjacent entrance opening O such as shown at 12 in broken lines in FIG. 1. Drill string 10 may have a diameter of around three and one-half inches for example.

Figure 3:
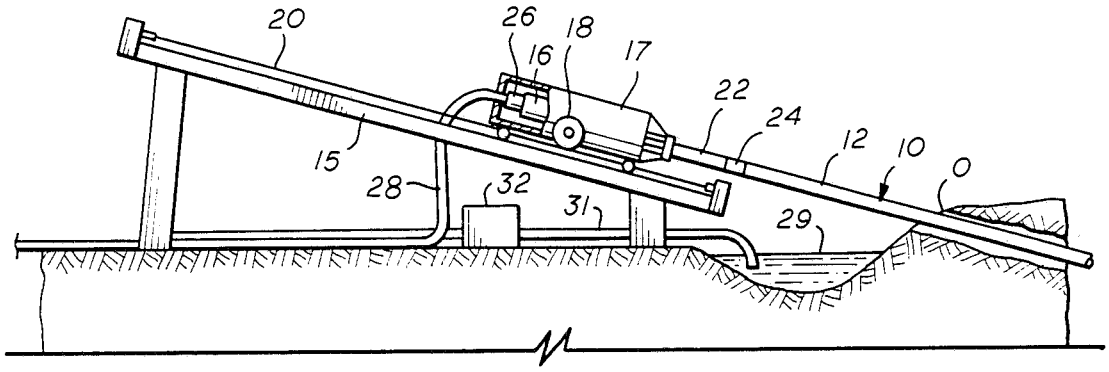
FIG. 3 is a schematic side elevation, partly in section, of the entrance end of the pilot bore hole showing the thrust and rotating device for the drill string.

As shown in FIG. 3, an inclined ramp is shown at 15 and a hydraulic motor 16 is mounted for rotation on a carriage 17 which is mounted for axial movement along a suitable guideway on ramp 15, such as by a suitable pulley or cog wheel 18 driven by suitable drive means for moving carriage 17 along a taut cable 20, for example. Motor 16 may be used, selectively, to rotate a connecting shaft 22 which is connected at one end to a joint 24 attached to a pipe section 12 of drill string 10, thereby to rotate drill string 10, if desired. Shaft 22 is connected at its other end to a swivel or kelly 26 which is in turn connected to a hose 28 through which a suitable drilling fluid is circulated. Carriage 17 reciprocates back and forth as drill pipe sections 12 are added by making and breaking joint 24.

Drilling mud circulated through hose 28 is supplied to the drill string 10 and out suitable fluid passageways at the drill bit 14 for possible return through the bore hole to a sump at 29 adjacent the end of entrance opening O. A suitable hose shown at 31 is connected to a suction pump 32 for returning the drilling fluid or mud with the entrained cuttings to a mud hopper or bin shown at 33 for removal of the cuttings, and again providing drilling fluid to hose 28 as is well known in the art. In some instances, particularly where soft formations are encountered, the drilling mud and entrained cuttings will be absorbed or received within recesses in the adjacent formation and not flow out of opening 0.

Drill string 10 is standard and normally made up of a plurality of drill pipe sections 12 which are added to the drill pipe string at joint 24. The pipe sections 12 are advanced in the earth by advancing carriage 17 and hydraulic motor 18 connected to a suitable source of hydraulic fluid (not shown) down ramp 15.

Leading pipe section 12A has spud bit 14 on its leading end. Spud bits of various types are well known generally in the art for directional drilling or the like. Spud bit 14 discharges a high velocity drilling fluid from a discharge nozzle 30 on its leading end at a location closely adjacent the formation thereby to obtain a highly effective excavating action to advance the drill string. Spud bit 14 preferably discharges fluid in a direction parallel to the axis of the drill string 10 and has an inclined planar end surface 34 forming a ramp and a rear planar shoulder 35. An arcuate shoe or wear plate 36 is secured to the outer periphery of leading pipe section 12. It is noted that bore hole B has a diameter larger than the maximum diameter of any portion of the drill string 10 moving through the hole.

Figure 4:
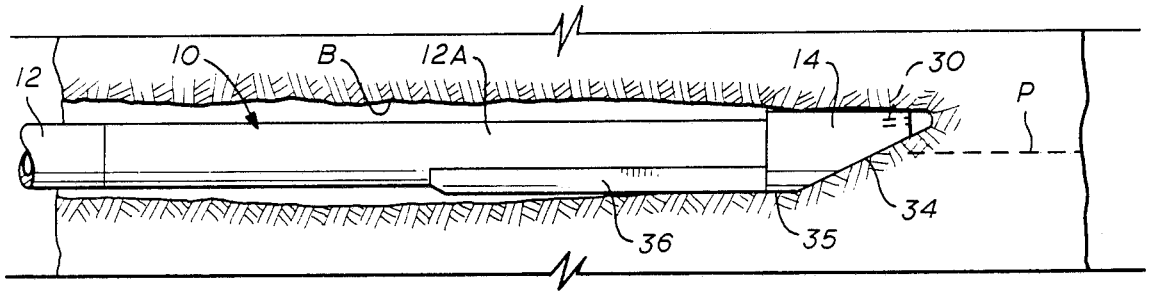
FIG. 4 is a schematic side elevation of the end of a drill string showing a spud bit for forming the initial pilot bore hole shown in FIG. 1.

The drilling fluid such as bentonite may be pressurized from around one hundred (100) psi to around two thousand (2000) psi, for example. The longitudinal or discharge axis of discharge nozzle 30 is parallel to, but offset from, the longitudinal axis of drill string 10 to aid in deflecting end section 10A in the direction of the offset. It is apparent that leading end section 12A may be guided also by rotation of drill string 10 through a defined angle. To provide an effective guiding action, the offset of nozzle or orifice discharge opening 30, or the offset of the center of the volume of fluid being discharged in the event more than one discharge opening is utilized, should be at least greater than around three-fourths ($\frac{3}{4}$) inch. As an example, with a spud bit having a diameter of five (5) inches as shown in FIG. 4, nozzle 30 is around three-eighths ($\frac{3}{8}$) inch in diameter and offset one (1) inch from the longitudinal center line of leading section 12A.

It may be desirable under certain conditions to have more than one discharge nozzle, but in any event, the center of the combined jets of drilling fluid being discharged is parallel to and preferably offset from the longitudinal axis of leading section 12 in the desired travel path. The ramp formed by inclined planar end portion 34, rear shoulder 35, and shoe 36 ride along the surface of bore hole B opposite the desired direction of deviation and aid in guiding leading pipe section 12A along travel path p. Spud bit 14 thus moves along path P in a thrusting action without being rotated except for a predetermined partial rotation to obtain angular orientation to guide leading pipe section 12A.

Arcuate path P can be controlled or guided without withdrawing of the drill string from the earth primarily by orientation of spud bit 14 by a partial rotation of the drill string 10 through a defined angle, but such control may also be dependent on such factors or parameters, for example, as the thrust on the drill string and the volume of drilling mud passed to the drill string, as is well known in the art. For further details concerning the deviation or deflection of the drill string for directional drilling or the like, as well known in the art, reference is made to aforementioned co-pending application Ser. No. 853,344; U.S. Pat. Nos. 2,646,254 dated July 21, 1953; and 3,713,500 dated Jan. 30, 1973, as examples.

The diameter of bore B is sufficiently larger than the diameter of pipe string 10 to provide an annulus to permit the discharge of the drilling fluid and cuttings from bore B. Utilizing a drill pipe string of a maximum diameter around three and one-half ($3\frac{1}{2}$) inches, bore B may be around five (5) inches in diameter to provide adequate clearance for the passage of drill string 10 and the flow of cuttings and drilling fluid from bore B.

When leading drill section 12A reaches exit opening E and pilot bore hole B is completed, it is now desirable to enlarge the pilot bore hole for receiving a production conduit or pipe shown in the drawings as a pipeline 38. The production conduit may be any of several types of continuous conduit, such as, for example, casing, pipe, cables, or the like, and more than one production conduit may be installed in enlarged opening D. Under certain conditions where a small diameter cable, such as three (3) to four (4) inches in diameter, is to be positioned within the hole B, it may not be necessary to enlarge the diameter of the pilot bore hold.

Figure 5:
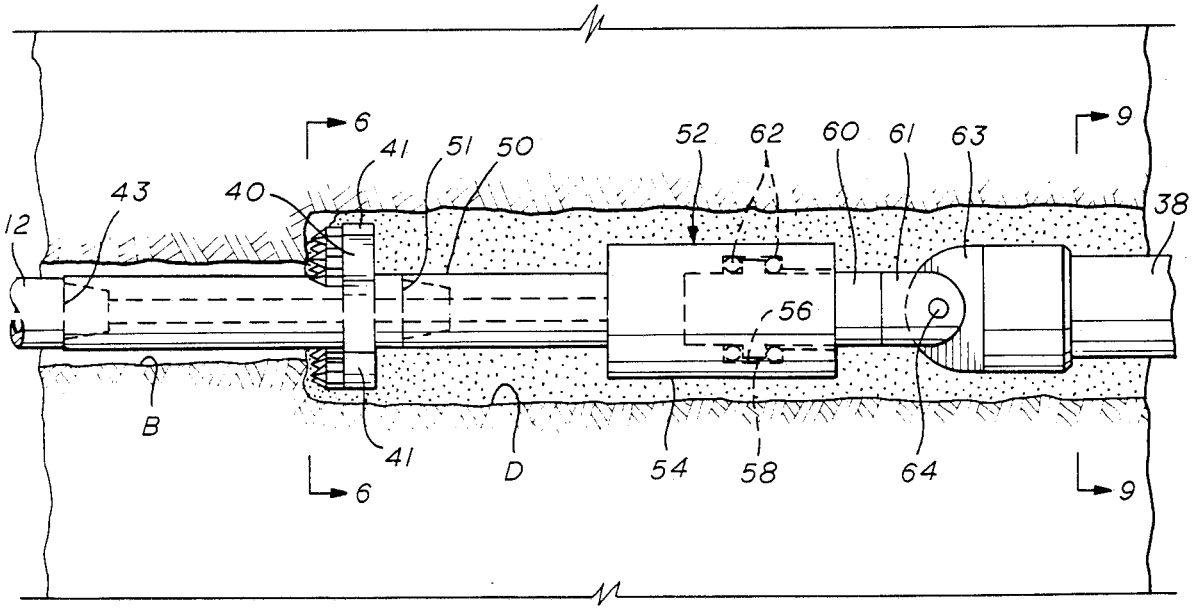
FIG. 5 is a schematic side elevation of the end of the drill string connected to a reamer and production conduit within the bore hole for pulling the reamer and production conduit through an enlarged bore opening formed by the reamer.

For enlarging the hole B, a reamer indicated generally at 40 is shown in FIG. 5. Reamer 40 has three (3) spaced blades 41 with cutting teeth 42 thereon and is coupled at 43 to the end of drill string 10 for rotation by drill string 10 and motor 16. Leading pipe section 12A and spud bit 14 thereon along with any associated instrumentation (not shown), is first removed from the end of drill string 10 prior to the connection of drill string 10 to reamer 40.

Figure 6:
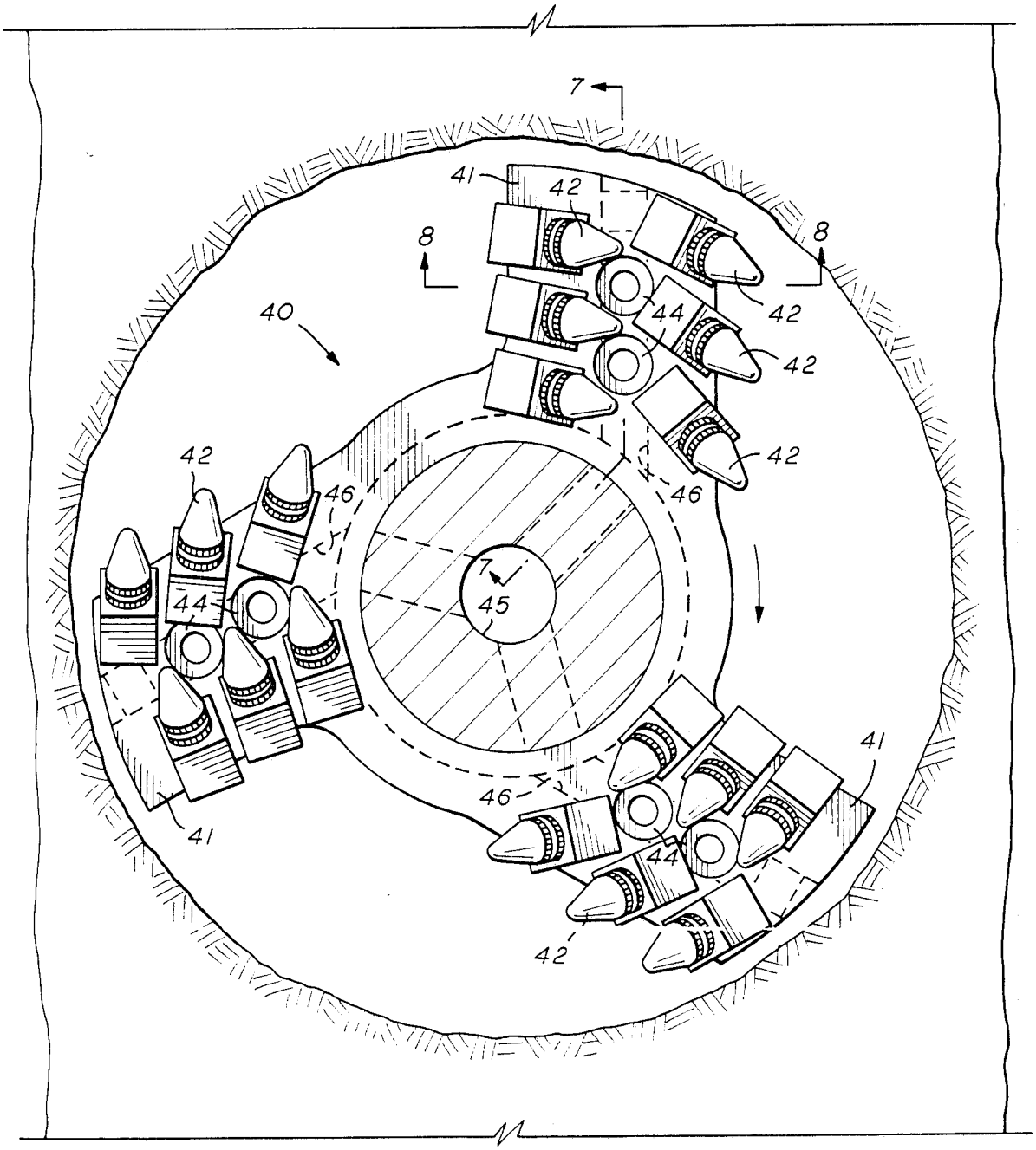
FIG. 6 is a section taken generally along the line 6—6 of FIG. 5 and disclosing nozzles in the reamer for discharging cement from the drill string into the bore hole.
Figure 7:
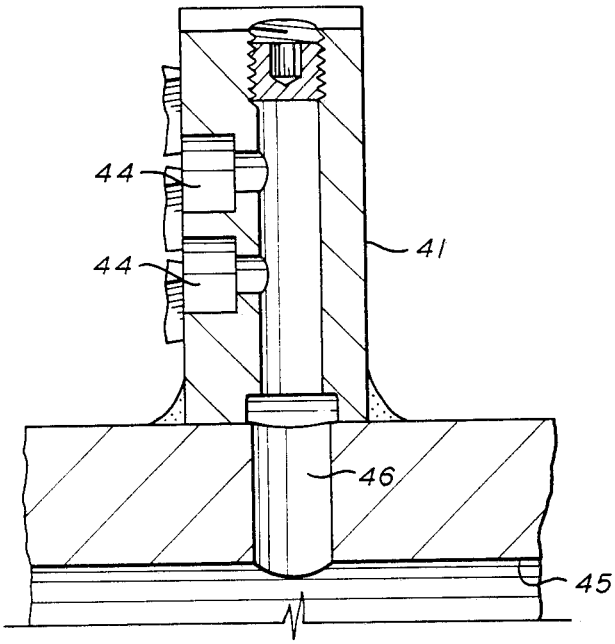
FIG. 7 is a section taken generally along line 7—7 of FIG. 6.
Figure 8:
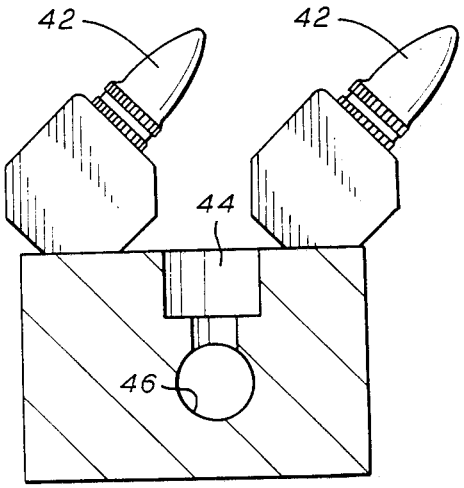
FIG. 8 is a section taken generally along line 8—8 of FIG. 6.

As shown particularly in FIG. 6, reamer 40 has discharge nozzles 44 forming discharge orifices on each blade 41 of a diameter adequate for the discharge of drilling fluid or cement as desired from central bore 45 and branch passages 46 to nozzles 44. The discharge of the drilling fluid or cement from nozzles 44 is against the formation to be engaged of cutting teeth 42 in the reaming operation and the cuttings along with the drilling fluid flows into the formation or into the annulus around the outer circumference of reamer 40.

Figure 2:
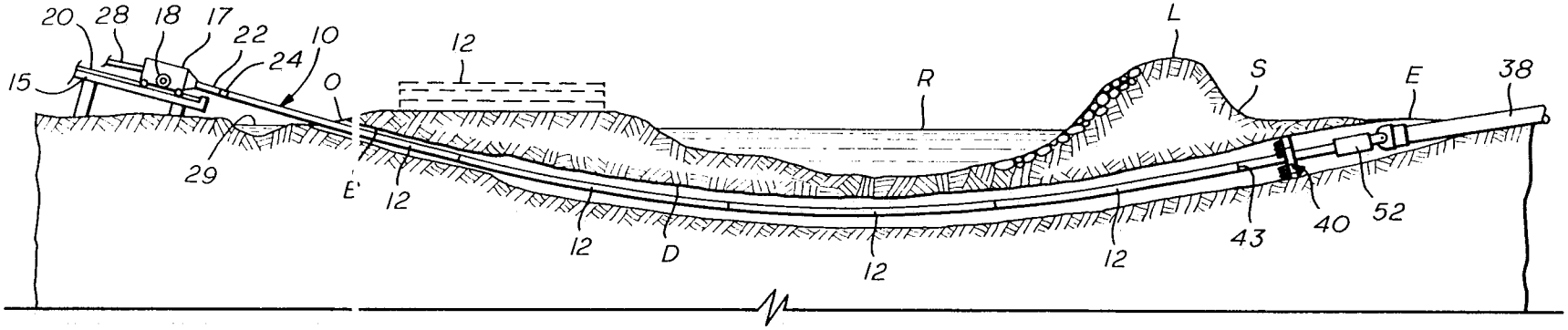
FIG. 2 is a schematic cross-section similar to FIG. 1 but showing an enlarged bore opening and a drill string pulling a production conduit through the enlarged opening and simultaneously supplying cement to the annulus about the production conduit as it is being pulled within the bore opening.

While production conduit of pipe 38 may be connected to reamer 40 for installation simultaneous with the initial reaming operation or step, it is preferable to pre-ream the initial bore hole B to the enlarged diameter opening or bore D prior to the installation and pulling of pipeline 38 within the enlarged opening. Also as shown in FIG. 2, it is preferable to have a portion of the length of initial bore B, such as sixty (60) to one hundred (100) feet, for example, to remain adjacent entrance opening O so that the flow of cement slurry from entrance opening O will be restricted by the small diameter bore during the cementing of annulus A about pipeline 38. This is particularly advisable where an obstruction might be encountered in the formation when reaming the large diameter hole. If an obstruction is encountered while reaming the large diameter hole, it is desirable that production conduit 38 not be connected to reamer 40 so that the reamer will be freely movable for removal of the obstruction. For this purpose, under certain types of operation, reamer 40 is pulled through the pilot hole for enlarging the opening without having the production conduit connected 38 thereto. After the pilot hole has been enlarged, reamer 40 is then pushed back through the empty hole to the exit side and production conduit 38 is then attached to the reamer. Then, the production conduit and reamer are pulled through the enlarged hole for installation of the production conduit thereby to insure that the enlarged hole is clear of any obstructions. Also, less power is required to pull production conduit 38 into place if the hole has been previously enlarged.

For connecting production conduit 38 to reamer 40, a swivel indicated generally at 52 has a small diameter extension 50 threadedly connected at its forward end to reamer 40 at joint 51. Swivel 52 includes an outer enlarged diameter body 54 having an inner annular recess 56 receiving a force transmitting flange 58 of inner concentric swivel body 60. Bearings 62 transmit loads between inner swivel body 80 and outer body 54 while permitting relative rotation between reamer 40 and production pipe 38. Preferably pipe 38 enters the bore hole B without any rotation at all although in some instances it may be desirable to rotate a production conduit being installed. Swivel body 60 has a clevis defining two spaced arms 61 which receive an extension 63 threaded within the adjacent end of production conduit 38 and pivotally connected to arms 61 by pin or bolt 64.

Extension or sleeve 63 is normally threaded within an end of production pipe 38 which is formed of a plurality of welded sections as common for pipelines. It is to be understood, however, as well known in the art, that extension or sleeve 63 could be secured by other means to a production conduit, such as, for example, by welding, bolted connection, or other types of threaded connections. Reamer 40 is of a diameter larger than the diameter of production casing 38 so as to form a suitable annulus A in the enlarged diameter opening D. For example, if production casing or pipe 38 is of a diameter of twenty (20) inches, reamer 40 may be of a thirty (30) inch diameter to provide a five (5) inch annulus A about the outer peripheral surface of production pipe 38.

As shown schematically in FIG. 10, mud is supplied to drill string 10 from mud bin having an upper chute 68 for receiving suitable materials for the mud. Mud from bin 33 is pumped through suction line 70 by positive displacement pump 72 through line 74 to hose or line 28. A quick disconnect joint 76 is provided between mud line 28 and line 74. Alternatively, if desired, cement in the form of a cement slurry may be pumped through line 28 to drill string 10 as will be explained.

For supplying cement to the annulus A about pipeline 38, a cement supply line 78 is connected to line 28 at joint 76. A source of cement is shown schematically at 80 and may comprise a cement mixer, for example, which discharges cement into a supply line 82 to a positive displacement pump 84 to provide cement at a predetermined pressure and volume through line 78 to drill string 10 as desired. Pump 84 may be a large capacity pumping vehicle and as an example, cement may be supplied at a pressure of around four hundred (400) psi at a volume of between around twenty-five (25) to forty (40) cubic feet per minute dependent on the size of annulus A.

In operation bore hole B is drilled along the predetermined underground arcuate path P between entrance opening 0 and exit opening E as shown in FIG. 1 with drilling fluid or mud being supplied by pump 72 to line 28 and drill string 10 for discharge through nozzle 30 in spud bit 14. Spud bit 14 is thrust along the predetermined path P by hydraulic motor 16 on carriage 17 for movement along inclined ramp 15. Upon exit of spud bit 14 at exit opening E, spud bit 14 and associated leading pipe section 12A are removed from drill string 10 and reamer 40 is attached thereto. Then, drill string 10 is retracted to pull reamer 40 along bore hole B in an opposite direction as shown particularly in FIG. 2 for enlarging pilot bore hole B to the enlarged diameter shown at D. Normally, at a location around fifty (50) to one hundred (100) feet from opening O, the reaming operation is stopped and reamer 40 is then pushed back through enlarged opening D to exit opening E for connection to pipeline 38. During the reaming operation, drilling mud is supplied by positive displacement pump 72 from mud bin 33 through line 74 to supply line 28.

Upon return of reamer 40 to exit opening E, swivel 52 and the leading end of pipeline 38 are connected at joint 51 to reamer 40. Also, line 28 is connected to cement line 78 at disconnect disconnect joint 76 upon disconnection of line 74 so that cement is supplied through hose 28 to drill string 10 for discharge from nozzles 44 into annulus A. Then, reamer 40 and pipeline 38 are pulled along enlarged opening D towards entrance opening O with the cement slurry being discharged continuously through nozzles 44 for filling the annulus A. Installation of pipeline 38 must be completed prior to the time that the cement sets, which may be around five (5) hours, for example. Suitable chemicals may be added to the cement mixture to retard the setting time. The remaining portion of small diameter bore B adjacent entrance opening O is reamed and pipeline 38 is thus installed along the entire original arcuate path P with the cement forming a hardened ring or annulus about pipeline 38 for securing pipeline 38 in place and for minimizing any washing or eroding action from water above the enlarged opening D.

When a small diameter production conduit, such as a telephone cable having a diameter of less than around four (4) inches, for example, is installed, it is not necessary to enlarge the initial bore hole B as the cable may be pulled through the initial bore hole B upon connection of the drill string to the production conduit after removal of bit 14 and leading drill string section 12A. For this purpose, as shown in FIG. 11, a cement discharge sub indicated generally at 86 is connected to the end of drill string 10 upon removal of section 12A. Cement discharge sub 86 has a plurality of circumferentially spaced cement discharge nozzles 88 thereabout and is connected at its trailing end to a swivel 52A. Swivel 52A is connected to the production cable 38A for transmitting the tensional or pulling loads between drill string 10A and cable 38A. While drill string 10A is normally rotated upon pulling of cable 38A through bore hole B, it may be desirable not to rotate drill string 10A. Swivel 52A permits rotation of drill string 10A without rotation of cable 38A. The cement forms an annulus about cable 38A in the same manner as in the embodiment of FIGS. 1–10 in which reamer 40 is employed.

Referring to FIG. 12, a modified method is illustrated in which the original drill string 10B is used for the discharge of the cement slurry into the annulus from the leading end of the leading pipe section 12B. The pilot bore hole B is first drilled and the spud bit along with the leading pipe section is removed from drill string 10B at the exit opening. Then the drill string 10B is pulled back through the bore hole B to the entrance opening 0.

Next, cement slurry is supplied to drill string 10B through line 28 as in the embodiments shown in FIGS. 1–11 and then drill string 10B is pushed along bore hole B from entrance opening O to exit opening B while simultaneously discharging the cement slurry from the end of leading pipe section 12B into the annulus. When drill string 10B reaches exit opening E, the bore in drill string 10B is flushed with clean water to clean the drill string of any cement. Then, upon setting of the cement, the drill string 10B is utilized as a conduit or casing for receiving a small diameter production conduit or cable. Normally, a rope is left in the encased drill string 10B upon completion of the cementing operation. The rope may be positioned within drill string 10B by a pig blown through the drill string by compressed air which also serves to clean the drill string. Later, the small diameter conduit or cable is pulled through drill string 10B by the rope from either the exit opening E or entrance opening O. The means for pushing or pulling drill string 10B through bore hole B is identical to that shown in the embodiments of FIGS. 1–11 and similar elements are identified by similar numerals with the addition of the letter "B".

It may be desirable to cement only a portion of the length of bore hole B, such as a portion adjacent the exit opening E or adjacent the entrance opening O, as these portions of bore hole B may be desired to be sealed. The cement about the drill string 10B has a thickness of around one (1) inch for a drill string having an outer diameter of five (5) inches.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In combination with a drill string having a bit on its leading end apparatus for boring an arcuate underground bore hole along a predetermined inverted arcuate path between two spaced surface locations in one direction of travel from an entrance opening to an exit opening, and means to supply drilling fluid through the drill string for discharge at its leading end into the bore hole;

a production conduit at the exit opening for installation within the bore hole;

means to connect said production conduit to the end of said drill string upon removal of said bit;

means adjacent said entrance opening for pulling said drill pipe string and production conduit connected thereto through said bore hole; and means adjacent said entrance opening for supplying cement to said drill string for discharge into the annulus adjacent the leading end of the production conduit simultaneously with the pulling of the conduit within the bore hole, said production conduit being accurately positioned within said bore hole prior to the setting of the cement about the production conduit.

2. The combination as set forth in claim 1 wherein a reamer is connected to the end of the drill string at said exit opening for enlarging the bore hole and said production conduit is connected to said reamer for being pulled through the enlarged bore hole, said reamer having discharge nozzles therein for the discharge of cement from the drill string into the annulus about the production conduit.

3. The combination as set forth in claim 1 wherein cement discharge nozzle means are connected to the end of the drill string at said exit opening and said production conduit is connected to said nozzle means for being pulled through the bore hole, said nozzle means having discharge openings therein for the discharge of cement from the drill string into the annulus about the production conduit.

4. Apparatus for boring an arcuate underground bore hole along a predetermined inverted arcuate path between two spaced surface locations in one direction of travel from an entrance opening to an exit opening on opposite sides of a waterway for installing a product line beneath the waterway; said apparatus comprising:

a drill string having a bit on its leading end;

means to supply drilling mud to said drill string and said bit during boring of the bore hole;

a production conduit adjacent one surface location for installation within the bore hole;

means to connect said production conduit to the end of said drill string upon removal of said bit;

means adjacent the other surface location for pulling said drill pipe string and production conduit connected thereto through said bore hole; and means adjacent said other surface location for supplying cement to said drill string for discharge into the annulus adjacent the leading end of the production conduit simultaneously with the pulling of the conduit within, the bore hole said production conduit being accurately positioned within said bore hole prior to the setting of the cement about the production conduit.

5. In combination with apparatus for boring an arcuate underground pilot bore hole along a predetermined inverted arcuate path between two spaced surface locations in one direction of travel from an entrance opening to an exit opening in a single boring operation of a single constant diameter, and then reaming an enlarged opening along the pilot bore hole in an opposite direction of travel from the exit opening to the entrance opening for receiving a production conduit therein;

means for positioning said production conduit within the enlarged opening and cementing the annulus around the production conduit comprising:

a drill pipe string adapted for connection to suitable boring and reaming means on its leading end for boring the pilot bore hole in said one direction of travel and then reaming the enlarged opening for the production conduit in said opposite direction of travel;

means adjacent said entrance opening for pulling said drill pipe string and production conduit connected thereto through said enlarged opening after reaming thereof; and means adjacent said entrance opening for supplying cement to said drill string for discharge into the annulus adjacent the leading end of the production conduit simultaneously with the pulling of the conduit through the enlarged opening, said production conduit being accurately positioned within said enlarged opening prior to the setting of the cement about the production conduit.

6. A method of boring an arcuate underground pilot bore hole along a predetermined path between two spaced surface locations in a single boring operating of a single constant diameter utilizing a drill bit on a leading drill pipe section of a drill string; said method comprising the steps of:

advancing the drill string having the drill bit thereon from a surface entrance location to a surface exit location;

discharging drilling fluid from said leading drill pipe section during the boring operation;

removing the drill bit from the drill string at the surface exit location;

attaching a reamer to the drill string at the exit location;

pulling the drill string and reamer back through the pilot bore hole from the exit opening to the entrance opening in an opposite direction of travel while rotating said reamer with the reamer forming an enlarged opening;

pushing the reamer back through the reamed hole from said entrance opening to said exit opening;

connecting the production conduit to the reamer at said exit opening;

then pulling the reamer and production conduit back through the reamed opening from said exit opening to said entrance opening for installing the production conduit within the enlarged reamed hole; and discharging cement from said reamer into the annulus between the production pipe and the adjacent surface of the enlarged reamed hole simultaneously with the pulling of the production conduit within the reamed opening.

7. A method for drilling an arcuate underground bore hole along a predetermined arcuate path in one direction of travel between two surface locations defining an entrance and an exit and installing a production conduit within the bore hole cemented in place; said method comprising the steps of:

advancing from one surface location a drill string having a drill bit on its leading end along the predetermined arcuate path to form a bore hole;

providing drilling fluid through said drill string to said drill bit during the drilling of the bore hole;

removing said drill bit from said drill string at the other surface location;

connecting a production conduit to said drill string at said other surface location;

pulling the drill string and production conduit from said other surface location to said one surface location; and providing cement through said drill string for discharge into the bore hole adjacent the leading end of said production conduit simultaneously with the pulling of the conduit through the bore hole.

8. The method as set forth in claim 7 further including the step of enlarging the bore hole prior to the pulling of the production conduit into the bore hole.

9. In combination with a drill string having a bit on its leading end for boring an arcuate underground bore hole along a predetermined inverted arcuate path between two spaced surface locations in one direction of travel from an entrance opening to an exit opening, and means to supply drilling fluid through the drill string for discharge at its leading end into the bore hole;

means adjacent said entrance opening for moving said drill pipe string through said bore hole between said entrance opening and said exit opening after the boring of the bore hole and removal of said bit; and means separate from said means to supply drilling fluid and adjacent said entrance opening, for supplying cement to said drill string for discharge from the leading end of the drill string into the annulus adjacent the leading end of the drill string simultaneously with the movement of the drill string along the bore hole between said entrance opening and said exit opening for setting of the cement in the annulus about a conduit therein.

10. The combination as set forth in claim 9 wherein said drill string comprises the conduit in the bore hole and the cement sets in the annulus about said drill string thereby to form a cement encased arcuate conduit particularly adapted to receive small diameter production cables.

11. In combination with a drill string having a bit on its leading end for boring an acurate underground bore hole along a predetermined inverted arcuate path between two spaced surface locations in one direction of travel from an entrance opening to an exit opening, and means to supply drilling fluid through the drill string for discharge at its leading end into the bore hole;

means adjacent said entrance opening for moving said drill pipe string through said bore hole between said entrance opening and said exit opening after the boring of the bore hole and removal of said bit; and means adjacent said entrance opening for supplying cement to said drill string for discharge from the leading end of the drill string into the annulus adjacent the leading end of the drill string simultaneously with the movement of the drill string along the bore hole between said entrance opening and said exit opening, wherein said drill string comprises a prodution conduit which is both connected to the end of the drill string upon removal of said bit, and pulled through the bore hole from the exit opening to the entrance opening thereof with the cement being simultaneously discharged from the drill string for filling the annulus about the production conduit, said cement upon setting encasing the production conduit and forming a cement encased arcuate conduit particularly adapted to receive small diameter production cables.

12. A method of boring an arcuate underground bore hole along a predetermined path between two spaced surface locations in a single boring operating of a single constant diameter utilizing a drill bit on a leading drill pipe section of a drill string; said method comprising the steps of:

advancing the drill string having the drill bit thereon from a surface entrance location to a surface exit location to form the arcuate bore hole;

discharging drilling fluid from said leading drill pipe section during the boring operation;

removing the drill bit from the drill string at the surface exit location;

pulling the drill string back through the bore hole from the exit opening to the entrance opening in an opposite direction of travel;

connecting a cement slurry supply to the drill string at said entrance opening;

then pushing the drill string back through the bore opening from said entrance opening to said exit opening; and simultaneously discharging the cement slurry from the leading end of the drill string into the annulus between the drill string and the adjacent surface of the bore hole as the drill string is pushed toward the exit opening whereby said drill string is encased within cement upon setting of the cement to form a casing to receive a small diameter production conduit.

13. A method of boring an arcuate underground bore hole along a predetermined path between two spaced surface locations in a single boring operating of a single constant diameter utilizing a drill bit on a leading drill pipe section of a drill string; said method comprising the steps of:

advancing the drill string having the drill bit thereon from a surface entrance location to a surface exit location to form the arcuate bore hole;

discharging drilling fluid from said leading drill pipe section during the boring operation;

removing the drill bit from the drill string at the surface exit location;

connecting a cement slurry supply to the drill string;

then moving said drill string through the bore hole between the exit and entrance openings; and simultaneously discharging the cement slurry from the leading end of the drill string into the annulus as the drill string is moved between the exit and entrance openings for filling the annulus and encasing a conduit in the bore hole upon setting of the cement.

14. The method as set forth in claim 13 wherein said step of moving the drill string through the bore hole includes pushing the drill string through the bore hole from said entrance opening to said exit opening and simultaneously discharging cement in the annulus about the drill string for encasing the drill string in cement upon setting thereof.

15. The method as set forth in claim 13 including the step of connecting a production conduit to the drill string at the exit end;

said step of moving the drill string through the bore hole includes the pulling of the drill string and connected production conduit through the bore hole from the exit opening to the entrance opening; and said step of simultaneously discharging the cement slurry from the leading end of the drill string includes filling the annulus about the production conduit following the drill string and thereby encasing the production conduit upon setting of the cement.

* * * * *